US005906054A

United States Patent [19]

Asher

[11] Patent Number: 5,906,054

[45] Date of Patent: May 25, 1999

[54] WEAPON SIGHT ASSIST

[76] Inventor: Lynn Eugene Asher, P.O. Box 123, Erskine, Minn. 56535

[21] Appl. No.: 08/740,241

[22] Filed: Oct. 25, 1996

[51] Int. Cl.[6] ..... F41G 1/467

[52] U.S. Cl. ..... 33/265; 124/88

[58] Field of Search ..... 33/233, 241, 262, 33/263, 265, 286, DIG. 21; 124/86, 87, 88, 89

[56] References Cited

U.S. PATENT DOCUMENTS

| | | | |
|---|---|---|---|
| 2,461,122 | 2/1949 | McQuitty | 33/265 |
| 2,788,701 | 4/1957 | Browning | 33/265 |
| 3,266,149 | 8/1966 | Powell | 33/265 |
| 3,477,130 | 11/1969 | Egan | 33/265 |
| 3,526,037 | 9/1970 | Crosby | 33/265 |
| 3,700,339 | 10/1972 | Steck, III . | |
| 3,813,790 | 6/1974 | Kaltmann . | |
| 4,120,096 | 10/1978 | Keller | 33/265 |
| 4,214,371 | 7/1980 | Bush . | |
| 4,294,017 | 10/1981 | Byrnes et al. . | |
| 4,606,629 | 8/1986 | Hines et al. . | |
| 4,638,565 | 1/1987 | Podany et al. | 33/265 |
| 4,977,677 | 12/1990 | Troescher, Jr. . | |
| 5,090,805 | 2/1992 | Stawarz . | |
| 5,092,053 | 3/1992 | Roberts . | |
| 5,121,547 | 6/1992 | Littlejohn . | |
| 5,122,932 | 6/1992 | Ziller . | |
| 5,127,166 | 7/1992 | Bishop . | |
| 5,152,068 | 10/1992 | Meister et al. . | |
| 5,201,122 | 4/1993 | Annunziata | 33/265 |
| 5,201,123 | 4/1993 | Booe . | |
| 5,274,925 | 1/1994 | Campbell et al. . | |
| 5,303,479 | 4/1994 | Rudovsky . | |

*Primary Examiner*—G. Bradley Bennett
*Attorney, Agent, or Firm*—Merchant, Gould, Smith, Edell, Welter & Schmidt

[57] ABSTRACT

An apparatus for assisting aim of a weapon by establishing a line from the device to the human eye from which relative weapon position can be obtained. The apparatus is positioned on the weapon away from the traditional sighting line that is utilized for target orientation. The apparatus does not require the use of electronic lighting; however, it is configured such that exterior light or electronic lighting provides the light necessary for operation.

20 Claims, 8 Drawing Sheets

FIG. 2A
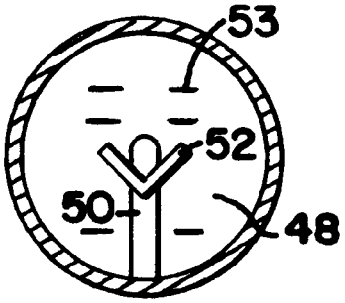
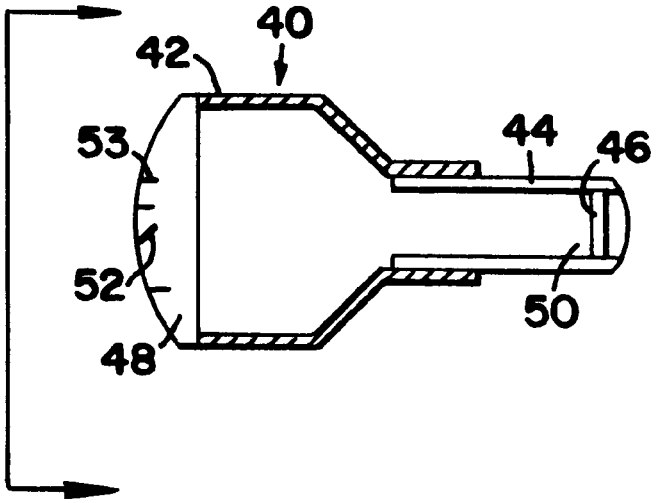
FIG. 2

FIG. 4
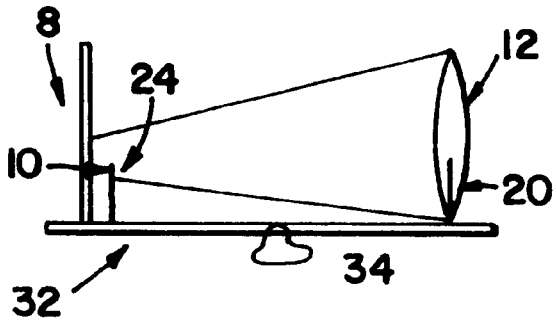
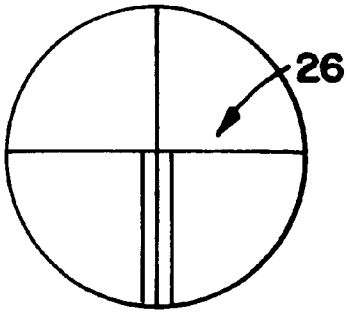
FIG. 5
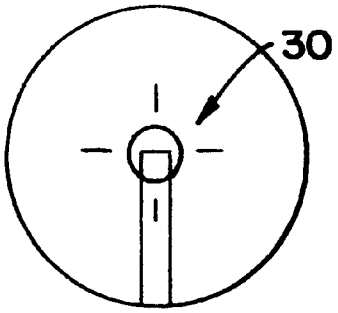
FIG. 6

WEAPON SIGHT ASSIST

BACKGROUND OF THE INVENTION

1. Field of the Invention

This invention relates generally to an apparatus for assisting aim of a weapon. More particularly, this invention is an apparatus positioned on a weapon for assisting aim of the weapon by establishing a sight line from the device to the human eye from which relative weapon position can be obtained.

2. Description of the Prior Art

In the past, weapon sights generally suffered from a parallax problem which affects accuracy due to the unreliable positioning of the weapon relative to the operator's eye. Improved weapon sights attempted to solve this problem through the use of a light beam generator mounted to the weapon and positioned to direct and collimate the beam toward the eye of the operator through a tubular housing. The problem with this type of weapon sight, is that it requires electronics, which limits its use by those archers who require no electronics on their bows. It also limits the reference point of the light beam to a single point of reference (the dot from the light beam). The light beam is only visible when the operator's eye is directly in line with the tubular housing and beam emitting therefrom. Therefore, such a system provides inadequate weapon positioning feedback. Because there is no feedback when the beam is not visible, the shooter has to make random adjustments in all directions in order for the light beam to become visible. This problem is exaggerated if the system is extremely sensitive, or when a shooter is taking aim from a non-traditional stance, for example, from a tree stand, or if the shooter applies twist or torque between the bow handle and the string, causing an increase in the error deviation factor.

One manner of solving the above-identified problem is to manipulate the sensitivity setting. However, if the sensitivity setting is too high, the problem is exaggerated and the user will lose the dot reference point more quickly. In contrast, if the sensitivity is too low, insufficient feedback is obtained.

The above identified light beam dot reference point system also has inadequate feedback when determining the difference between incorrect anchor point and incorrect bow vertical position. Because the dot reference point generated by the light beam is circular and placed in the center of the viewing area, it is not sensitive to slight off-vertical bow rotation. There is a need for a system that eliminates the limitations and problems introduced by utilizing a light beam circular reference point. Also, there is a need for a system with enhanced sight line sensitivity that provides more accurate alignment of the reference and sight line. Such a system would provide visual feedback as to the direction of movement of the weapon needed to find and establish a correct sight line from the device to the human eye. The system would also eliminate the parallax problem associated with non-vertical bow rotation.

SUMMARY OF THE INVENTION

The present invention generally provides an aiming device for a weapon, specifically a bow, wherein the aiming device is comprised of a luminous background, wherein the background has a first reference display positioned thereon or in association therewith, and at least one magnifying lens, wherein the magnifying lens has a second reference point centrally positioned thereon or in association therewith. The first and second reference points establish a correct bow position relative to the shooter by aligning the first and second reference points in a shooter's eye sight line. The aim assist device provides visual feedback, via the magnifying lens, and multiple points of reference through the first and second reference points. The first reference point allows a user to see the level of mis-alignment and degree of movement required to establish a correct sight line. The aim assist device may also include the ability to adjust its sensitivity level and display multiple levels of bow position feedback by lens sensitivity variation from center to outer surface area.

The aim assist device also includes the ability to operate without the use of electronics by using a contrasting background which may be exposed to exterior light, including natural light, and/or light gathering devices which provide contrast for viewing the first reference display.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described embodiments of the invention.

BRIEF DESCRIPTION OF THE DRAWINGS

FIG. 2 is a partially cutaway and partially sectioned view of an embodiment of the present invention;

FIG. 2A is a front facial view of the embodiment of the present invention shown in FIG. 2.

FIG. 4 is a perspective view of the magnifying lens and post reference display within the present invention illustrating the focal surface area of view seen by the shooter as it relates to a post reference point;

FIG. 5 is a view of what a shooter sees when looking into the present invention having cross-hair on the magnifying lens and post as the first and second reference points;

FIG. 6 is a view of what a shooter sees when looking into the present invention having circular reference on the magnifying lens and a post as the first and second reference displays;

GENERAL DESCRIPTION

In accordance with the teachings of this invention, a weapon aim and position assisting device for aligning a shooter's preferred eye position is disclosed. The weapon aim and position assisting device consists of a protective housing containing two referencing displays, wherein a first reference display which is on or associated with a background surface and is farthest from the eye, is magnified by at least one magnifying lens having on or in association therewith a sight reticle which acts as a second reference point. The first and second reference points can be of a plurality of different shapes and sizes, including for e.g. cross-hair, post or dot.

The background is comprised of light contrasting material and provides background contrast for the first reference display. The background may be illuminated by exterior light, including natural light, or electrically.

The magnifying lens sight reticle conforms to the size of the first reference display. The size of the first reference display is dependent on the degree of magnification provided by the magnifying lens and the distance between the first reference display and the magnifying lens. The magnification factor, reference point size and distance between the magnifying lens and reference point can be controlled to affect bow positioning sensitivity and visual correctness of the device.

The first reference point and sight reticle within the weapon aim and position assist device provide for symmetrical positioning of the weapon to which the device is mounted. Through the use of the first reference display and sight reticle with a bow, the shooter can establish a correct target sight line. The shooter utilizes the conventional front sight reference positioned between the eye and the target to aim at the target and simultaneously lines up the first reference point and sight reticle. Any movement of the weapon following proper weapon alignment is detected in a shift of the alignment of the first reference point and sight reticle. Mis-alignment of the first reference display and sight reticle indicates the weapon is incorrectly positioned and therefore inaccurate. Precise positioning of the weapon is easily established and maintained upon lining up the first reference display and sight reticle. Accurate lining of the first reference display and sight reticle indicates intersection of the target and aiming device sight lines at a given range. The use of a magnifying lens having a sight reticle in association therewith allows the shooter to see the alignment and misalignment and view the modifications necessary to bring the reference displays into alignment as the changes in weapon position are made.

DETAILED DESCRIPTION

Figure 1:
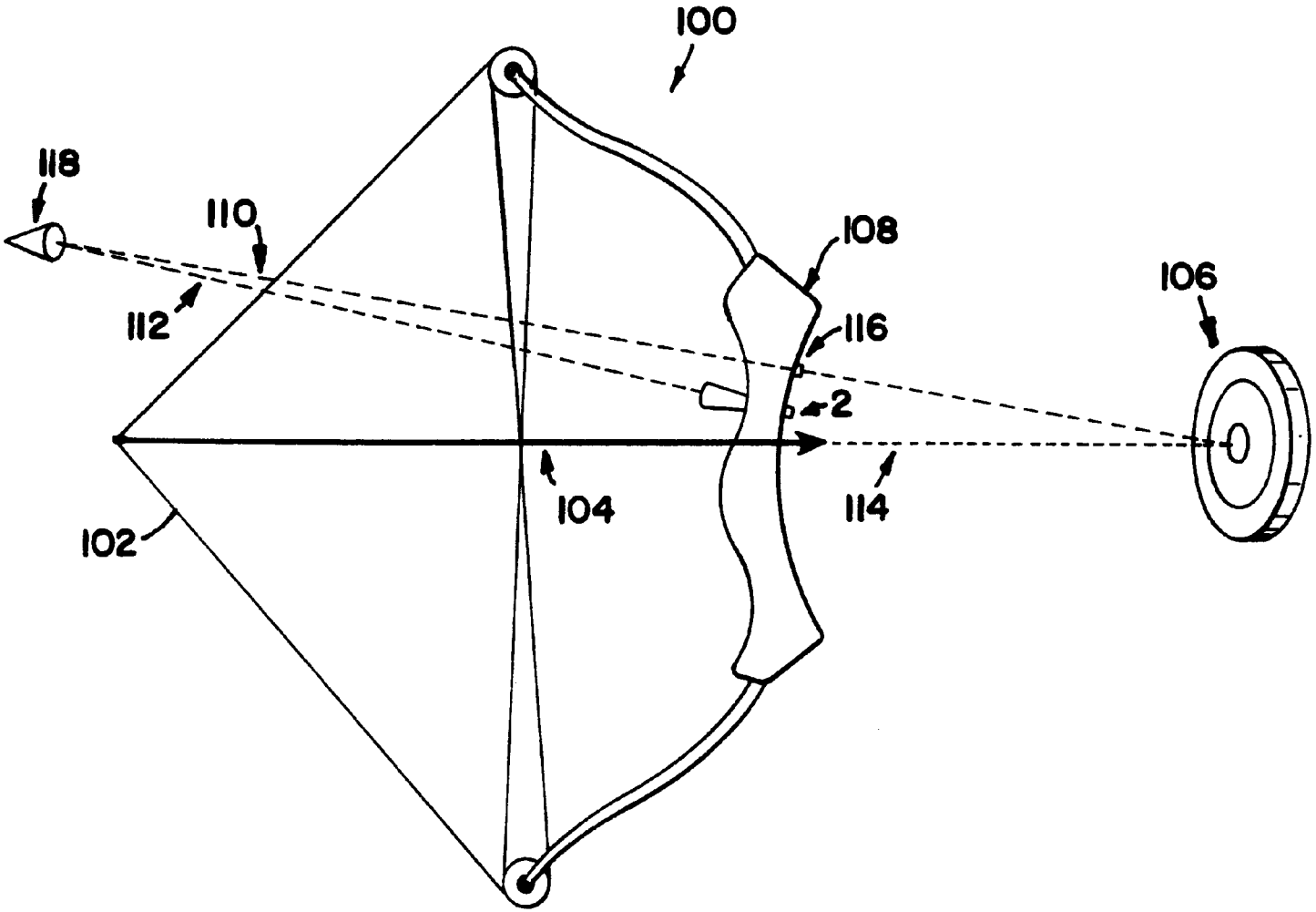
FIG. 1 is a perspective view of the aim assist device of the present invention applied to a bow.

Referring to FIG. 1 of the drawings, there is shown a weapon 100, which in the preferred embodiment is depicted as a bow. Although the preferred embodiment of the present invention is described in the context of the weapon being a bow, it is to be understood that the present invention is not limited to use on bows and may have relevance to other weapons such as rifles, pistols, etc.

As shown in FIG. 1, to assist a bow shooter in arrow 104 aiming, the present invention, a weapon aim and position assisting device 2 (hereinafter referred to as "aim assist device"), is attached to the riser or sight frame 108 of the bow 100 for maximum stability. The position of attachment of the aim assist device 2 to the riser 108 of the bow 100 is outside of the traditional sighting line, thereby reducing the device's ability to obstruct light, field of view and the target 106.

FIG. 1 also illustrates how a bow shooter, having an arrow 104 at full draw, utilizing the aim assist device 2 establishes a correct bow position. First, the shooter places the traditional front sight reference 116 of the bow 100 between the shooter's eye 118 and target 106, establishing a target sight line 110. The correct sight line 110 is a point view line along which the arrow flight line 114 and view line intersect at a given distance, preferably the distance to the target 106. The distance at which intersection occurs may be adjusted by moving the front sight reference 116 of the bow 100.

Next the shooter lines up the lens reticle and first reference display of the aim assist device 2 while maintaining alignment of the shooter's eye view 118 of the front sight reference 116 and target 106. Once the aim assist sight line 112 is properly aligned and the bow 100 is sighted correctly, the eye 118 position will intersect the aim assist device sight line 112 and target sight line 110. The target sight line 110, aim assist device 2 sight line 112 and arrow flight line 114 are all fixed in relative position to each other when the arrow 104 is at full draw. The relative position of the target sight line 110, device sight line 112 and arrow flight line 114 to the bow 100 remain the same regardless of the bow's 100 position. The aim assist device 2 sight line 112 may be adjusted to intersect the correct sight line 110 at any point, allowing for a choice of bow anchor point placement.

The anchor point establishes the correct sight line 110 by way of the eye's 118 position on the aim assist device 2 with respect to the device sight line 112. The distance the eye 118 is positioned from the aim assist device 2 on the device sight line 112 is determined by the bow 100 draw length and anchor point.

An embodiment of the invention is shown in FIGS. 2 and 2A. This embodiment was designed for non-electrical lighting, specifically the use of materials that are illuminated by exterior light, including natural light. As shown in FIG. 2, the device 40 may be comprised of a protective housing 42, a transparent end 44, a background 46 positioned within the transparent end 44, and a magnifying lens 48. The background 46, which is positioned at the closed end of transparent end 44, is comprised of a luminous material and has a first reference display 50 positioned thereon. The luminous background surface 46 provides a light contrast to first reference display 50. The magnifying lens 48 has a sight reticle 52 positioned thereon, functioning as a second reference point. The magnifying lens 12 also has a plurality of incremental markings 53 positioned on the upon the lens. In other embodiments, the sight reticle 52 or first reference display are not positioned directly on magnifying lens 48 or background 46 but are positioned in close proximity thereto.

Figure 3:
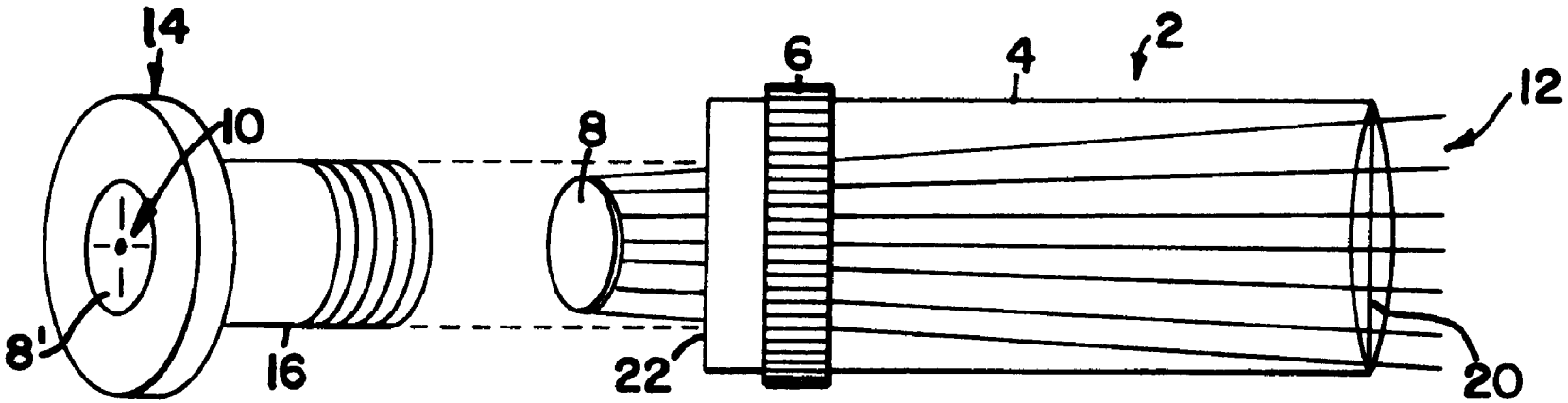
FIG. 3 is a partially cutaway and partially sectioned view of another embodiment of the present invention.
Figure 8:
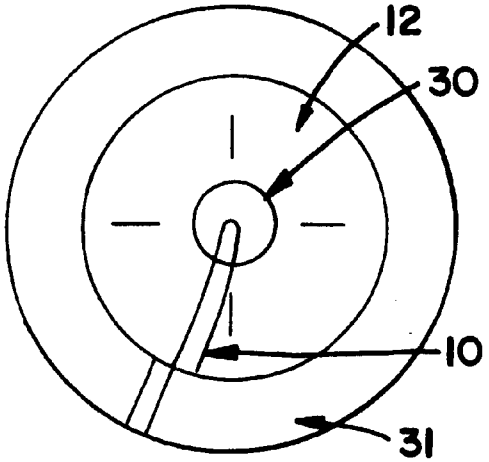
FIG. 8 is a view of what a shooter sees when looking into the present invention having circular reference on the magnifying lens, increasing magnification of the lens from the center to the outer perimeter, and a post as the first reference display.

Another embodiment of the invention is shown in FIG. 3. This embodiment was also designed for non-electrical lighting, specifically the use of materials that are illuminated by exterior light, including natural light. As shown in FIG. 3, the device 2 may be comprised of a protective housing 4, a transparent end 14, a background 8 positioned within the transparent end 14, a magnifying lens 12, and a thread lock ring 6 for locking the transparent end into a desired position.

The background 8, which is positioned at the closed end of transparent end 14, is comprised of a luminous material and has a first reference display 10 positioned on its face. The luminous background surface 8 provides a light contrast to first reference display 10 which may be enhanced by light gathering devices such as light concentrating fibers.

In another embodiment the invention shown in FIG. 3, first reference display 10 is not positioned on the luminous background surface 8, and is attached to the protective housing 4 in close proximity to the background surface 8. In this embodiment, the first reference point 10 is positioned within and attached to the transparent end 14 within the housing 4. The magnifying lens 12 has a sight reticle 20 positioned thereon acting as a second reference point. In other embodiments, the sight reticle 20 is not positioned directly on magnifying lens 12 but is positioned in close proximity thereto.

As illustrated in FIG. 3, it is the first reference display 10 and the sight reticle 20 that provide assistance to aiming and positioning of a weapon 100. First reference point 10 and sight reticle 20 provide the stable rear bow position reference point that a rear bow sight would have if a rear sight could be mounted at the necessary position on bow 100. The transparent end of housing 14 threadingly attaches to the first end 22 of the housing 4. The ability to threadingly attach transparent end 14 to housing 4 allows for the first reference display 10 to be moved closer to or further away from magnifying lens 12.

Modifying the distance between first reference point 10 and second reference point 20 changes the surface area view of the focal point 24 seen through magnifying lens 12, illustrated in FIG. 4. There is a direct correlation between the surface area size of focal point 24 and the sensitivity of the aim assist device 2. When the surface area of focal point 24 is increased, the sensitivity of the aim assist device 2 is decreased. And, when the surface area of the focal point 24 is decreased, the sensitivity of the aim assist device 2 is increased. The increments by which the sensitivity of the device can be changed is dependent on the threading on the transparent housing 14 and the type of reference used for the first reference point. If a cross hair is used, turning transparent housing 14 in 90° increments allows the sensitivity to be increased or decreased in ¼ increments. If the first reference point is a post, the transparent housing requires 360° rotation to increase or decrease sensitivity.

Thread lock ring 6 provides the ability to stabilize sensitivity at a given level by way of locking the transparent end 14 in position and thereby stabilizing the distance between the first reference display 10 and the sight reticle 20.

In another embodiment, the background surface 8 is rotatably attached to the protective housing 4. The background surface 8 can be locked into position once the sensitivity has been adjusted. This independent rotation allows for fine adjustment in increments other than, for example, 90 degrees and 360 degrees of the first reference display 10 on the background surface 8 to compensate for any movement of the transparent end housing 14. In other embodiments, sensitivity of the aim assist device 2 can be changed by increasing or decreasing the magnifying lens 12 power or modifying the distance of the aim assist device 12 from the eye.

The present invention utilizes a first reference display extending to the center and circumference of the magnifying lens, which allows the shooter to simultaneously see two relative but different sensitivity positions. The first sensitivity position being the center of the lens and a second being the outer circumference of the lens. The net effect of this center to circumference viewing of the first reference is to show the progressive sensitivity of the lens from center to outer circumference. If the less sensitive first reference is in fact centered, the first reference line will remain straight to the outer circumference of the lens. However, if the first reference line is slightly off center on the lens, the line will curve with the progressively more sensitive outer circumference. This results in dual sensitivity readings.

Figure 7:
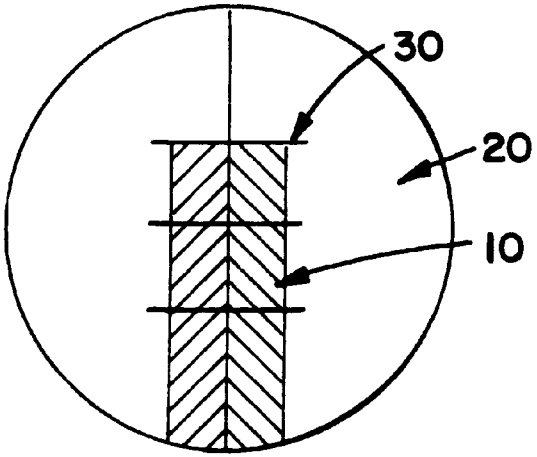
FIG. 7 is a view of what a shooter sees when looking into the present invention having shot range adjustments as the second reference point on the magnifying lens and a first reference display.

In another embodiment, the sensitivity of the aim assist device 2 is controlled by increasing the thickness or curvature of the magnification lens 12 from the center to the perimeter of the lens. As shown in FIG. 7, the increased thickness or at the outer edge 31 of the magnifying lens 12 increases the sensitivity at the outer edge, resulting in refraction of the first reference display 10 to increase the visual impact of error.

The size of first reference point 10 is determined by the focal distance resulting from magnifying lens 12, device size and extent of magnification required for sensitivity and visual correctness. The second reference point 20 is sized in accordance with the first reference point 10 to provide visual correctness, sighting sensitivity and the best visual proportional relationship.

FIG. 5 is illustrative of what a shooter sees when looking through an aim assist device 2 having a cross-hair 26 as the sight reticle on magnifying lens 12. The sight reticle associated with magnifying lens 12 may also include, as shown in FIG. 6, a hoop 30 or, as shown in FIG. 7, shot range adjustments 28. The use of shot range adjustments that are aligned with first reference display 10 indicate the possible range changes that could be implemented without elevating the traditional target sight reference. Instead, the angle of the bow 100 relative to the eye can be changed and viewed through magnifying lens 20 to affect the range change. The shot range adjustments on magnifying lens 20 may be reflective of 10 yard incremental range changes. Accordingly, FIG. 7 is illustrative of bow lined up to strike a target 30 yards from the shooter. In other embodiments, the sight reticle associated with magnifying lens 12 may also include the combination of cross-hair 26, hoop 30, and additional lines.

Figure 9:
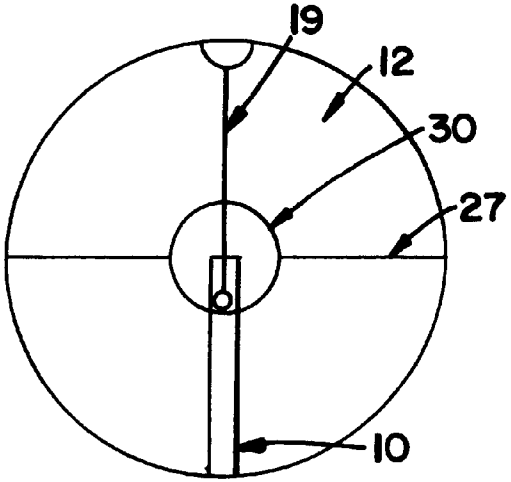
FIG. 9 is a view of what a shooter sees when looking into the present invention having circular reference and vertical markings on the magnifying lens, a post as the first reference display, and a gravity pendulum attached within the protective housing, proximate to the second reference display.

FIG. 9 depicts another embodiment of the present invention wherein a ground reference system comprised of vertical markings 27 on the magnifying lens 12, a sight post 10 as first reference display, and a gravity pendulum 19 attached to the inside of the protective housing proximate to the second reference display allows for vertical alignment.

Figure 10:
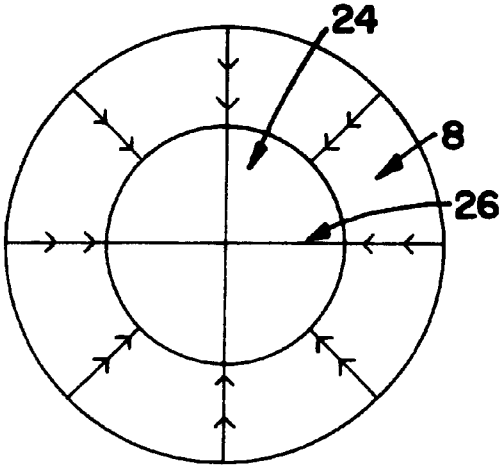
FIG. 10 is a view of the present invention having lines on the background surface that extend beyond the viewing area of the magnifying lens and indicate direction toward the center of the first reference display.

In other embodiments, the lines of first reference display on the background surface may extend beyond the focal point surface area 24 viewed through magnifying lens 12 to provide reference points outside the cross-hair 26. Accordingly, as shown in FIG. 10, extensions beyond the correct bow position viewing area provide feedback as to which direction the bow position changes need to be made.

Figure 11:
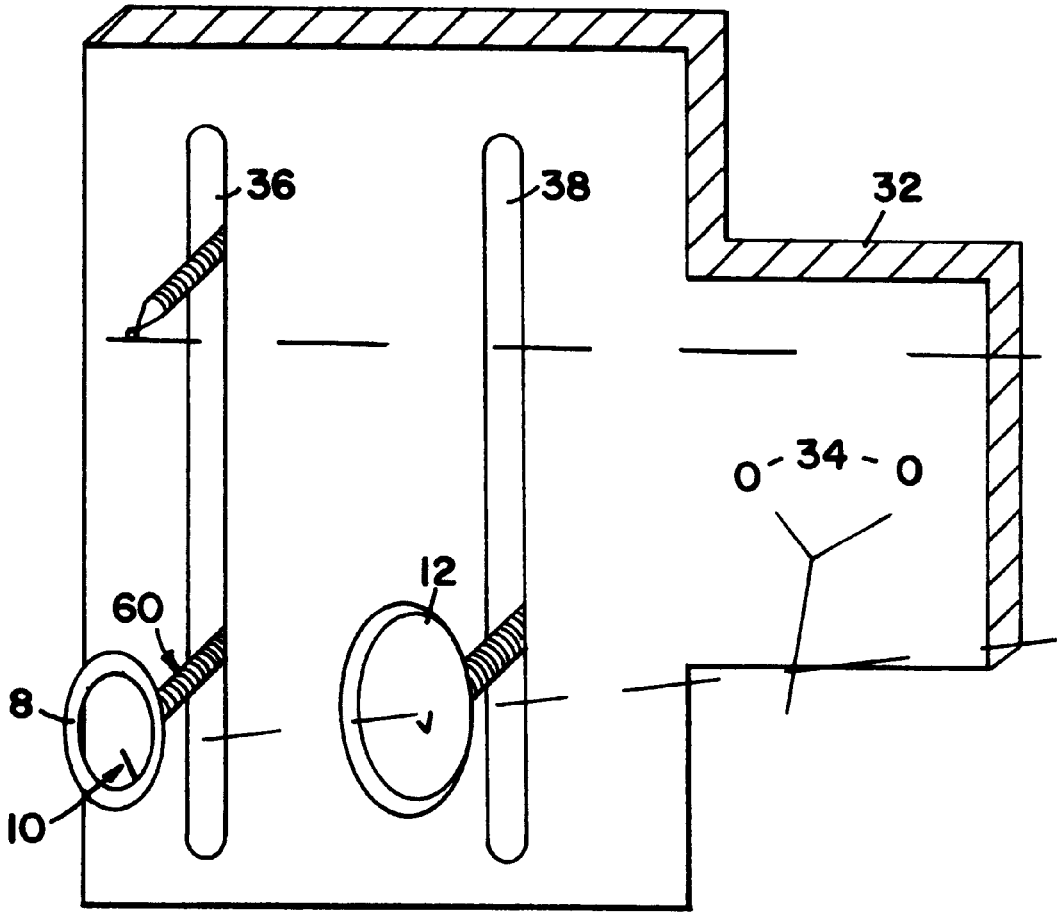
FIG. 11 is a view of another embodiment of the present invention.

Another embodiment of the present invention, as shown in FIG. 11, includes a system wherein the aim assist device 2 is not within a housing and is comprised simply of a mounting frame 32, a first reference display comprised of a sight post 10 positioned on a background disk 8, and a magnifying lens 12 having a sight reticle positioned thereon. In another embodiment, the first reference display is not positioned on the background surface 8 but is positioned in association therewith to provide background contrast. This embodiment is generally shown in FIG. 11 wherein the mounting frame of the aim assist device 32 is attached to the riser of the bow at the traditional target sight view frame slots by attachment mount (not shown).

The sight post 10 and background 8 are attached to the mounting frame 32 via an attachment arm 60 within a first attachment slot 36 of the mounting frame 32. The attachment arm allows movement of the sight post to adjust aim assist device both vertically and horizontally. The magnifying lens 12 is also attached to the mounting frame 32 via an attachment arm within a second attachment slot 38 within the mounting frame 32 and also provides for horizontal and vertical movement of the magnifying lens 12. Movement of the magnifying lens and/or first reference 12 modifies the alignment of first and second reference allowing an adjustment of the aim assist device of bow position and anchor point placement. The attachment arm screws in and out and slides up or down the slot for alignment.

Although it is not illustrated in FIGS. 2, 3 and 4, it is to be understood that the present invention could accomplish sensitivity control by using multiple magnifying lenses of different magnifications. The present invention also contemplates the use of lenses to de-magnify the first reference display to extend the first reference point's distance from the second reference display and thereby create sensitivity of the aim assist device.

One of ordinary skill in the art would understand that embodiments of the present invention would utilize a variety of methods to illuminate the background surface 8. With respect to embodiments comprised of the transparent housing, the background surface 8 could be illuminated by mirrors reflecting exterior light, including natural light onto the surface, or by lenses which concentrate the light onto the surface. In another embodiment (not shown), it is contemplated that the structure of the aim assist device shown in FIGS. 2 and can be accomplished without the use of transparent materials for the manufacture of transparent ends 14 and 44. In these embodiments, the background surface would be comprised of a non-illuminating surface and the first reference display would be comprised of an illuminating fiber attached to or positioned in association with the non-illuminating surface. Another embodiment wherein the housing is not comprised of transparent material for the protective housing, slits in the closed end of the housing are utilized to create the first reference display. One of ordinary skill in the art would understand that light fibers could be used with these slits to illuminate or create the first reference display.

The present invention also contemplates the use of electrical light to illuminate the background. One of ordinary skill in the art would understand that both internal and external electrical sources could be used to illuminate the background.

Figure 12A:
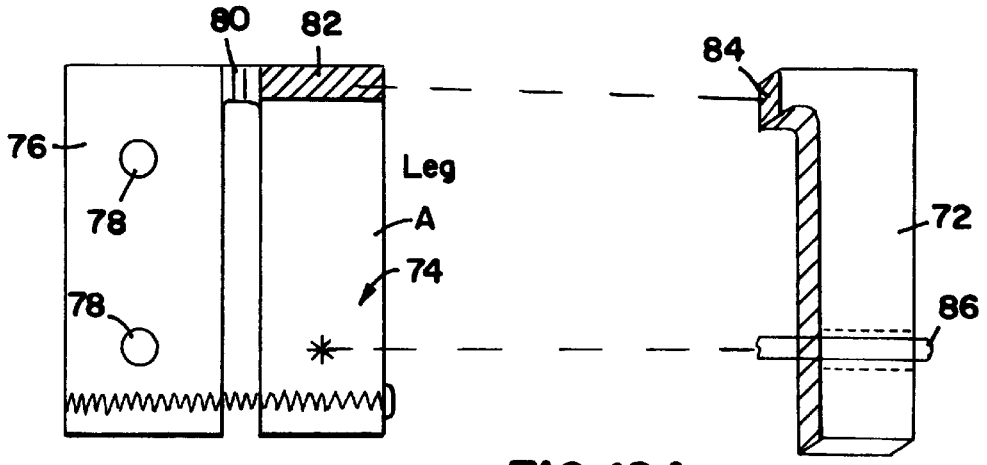
FIG. 12A is another view of the stationary aim assist device mount.
Figure 12:
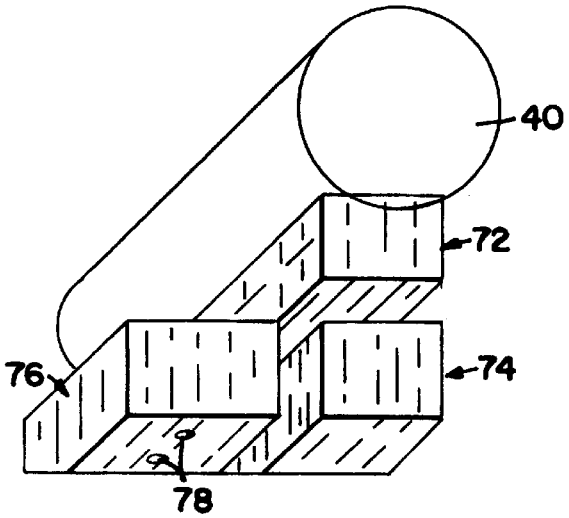
FIG. 12 is a view of a stationary aim assist device mount that is attached to the bow.
Figure 12B:
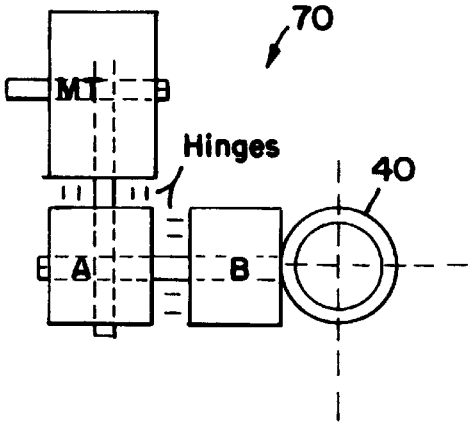
FIG. 12B is another view of the stationary aim assist device mount.

FIG. 12, is illustrative of a stationary aim assist device mount that is attached to the bow. The stationary mount also includes the ability to adjust the alignment of the device by way of moving attachment leg 72 which the aim assist device rests upon. The stationary mount is comprised of three legs, 72, 74, 76 device. The first leg 76 attaches the stationary mount to the riser of the bow by way of screws through attachment mount holes 78. The second leg 74 is attached to first leg 76 by way of a hinge 80. The third leg is attached to the hinge face 82 of the second leg 74 at the third leg hinge face 84. Because the aim assist device 40 rests upon the third leg 74 of the stationary mount 70, the aim assist device can be moved when the third leg is moved by way of a threadingly engaging an adjuster 86 with an adjustment hole 88 within the second leg 74.

It is to be understood that while certain embodiments of the present invention have been illustrated and described, the invention is not to be limited to specific forms or arrangements of parts herein described and shown. Changes can be made in detail especially in matters of shape, size and arrangement of parts within the principles of the present invention to the full extent indicated by the broad general meaning of the appended claims.

What is claimed:

1. A weapon positioning device for establishing a correct weapon position relative to a shooter, said device comprising:

a background with a first reference display positioned in association with said background; and a magnification lens with a second reference display positioned in association with said magnification lens;

wherein one of said background and said first reference display is illuminated by light from a light source external to said device to provide a contrast between said first reference display and said background; and whereby the correct weapon position is established by the shooter looking through said magnification lens and aligning said first and second reference displays in a shooters eye sight line against said background.

2. The weapon positioning device of claim 1 wherein said first reference display is positioned on said background.

3. The weapon positioning device of claim 1 wherein said second reference display is positioned on said magnification lens.

4. The weapon positioning device of claim 1 further including:

a housing having a first end and a second end, wherein said background is positioned within said first end, and said magnification lens is positioned within said second end, and wherein said first end of said protective housing is comprised of transparent material.

5. The weapon positioning device of claim 1 wherein said background is comprised of a light manipulating material, said material being illustrated by natural light.

6. The weapon positioning device of claim 1 wherein said background is comprised of a light manipulating material being illustrated by electronic light.

7. The weapon positioning device of claim 1 wherein said background is comprised of a luminous material, said luminous material providing a contrast for viewing of said first reference display.

8. The weapon positioning device of claim 1 wherein said magnifying lens further includes distance incremental markings thereon, such that each marking, when aligned with said first reference display, indicates that the weapon is at a specified horizontal angle relative to the shooter, and whereby shot distance adjustments can be made by aligning an appropriate one of said distance incremental markings with said first reference display.

9. The weapon positioning device of claim 1 including a gravity reference system comprised of said magnification lens including vertical reference markings and a gravity pendulum associated with and viewed through said magnification lens.

10. The weapon positioning device of claim 1 wherein said background is illustrated by a light emitting device, said light emitting device electronically initiated.

11. The weapon positioning device of claim 1 wherein said first reference display is illuminated electronically.

12. The weapon positioning device of claim 1 wherein said first reference display is illuminated by natural light.

13. A weapon positioning device of claim 1 wherein said first reference is illustrated by light concentrating devices.

14. The weapon positioning device of claim 1 wherein said background is illustrated by light concentrating devices.

15. The weapon positioning device of claim 1 wherein said magnifying lens includes an inner portion having a first magnification factor and an outer portion having a second magnification factor, said second magnification factor being higher and of greater sensitivity than said first magnification factor.

16. The weapon positioning device of claim 15 wherein said first reference display includes a first part and a second part, and wherein when said first reference display is viewed by the shooter through said magnification lens, the first part is viewed through the inner portion of said lens and the second part is viewed through the outer portion of said lens.

17. The weapon positioning device of claim 1 wherein said first reference display extends beyond said magnification lens focal point field of view.

18. The weapon positioning device of claim 1 wherein said first reference display includes a center and further includes feedback markings that indicate direction of movement required to find said first reference display center.

19. The weapon positioning device of claim 1 further including a protective housing, and wherein said background and said first reference display are rotatably attached to said protective housing allowing for clockwise or counter clockwise rotation of said background and said first reference display.

20. The weapon positioning device of claim 1 further including a housing having a first end and a second end, wherein said first reference display is positioned within said first end, and said magnification lens is positioned within said second end, and wherein said first end of said protective housing is threadingly attached to said second end of said protective housing, wherein rotation of said first end of said protective housing modifies the distance between said first reference display, and said magnification lens thereby modifying weapon positioning device sensitivity.

* * * * *